United States Patent [19]

Willem et al.

[11] 4,409,432

[45] Oct. 11, 1983

[54] BINDING RETAINING AN ELECTRICAL CONDUCTOR IN A CIRCUMFERENTIAL GROOVE AROUND A RIGID INSULATOR

[75] Inventors: Michel Willem, Abrest; Lucien Gamet, Saint-Yorre, both of France

[73] Assignee: Societe Anonyme dite: Ceraver, Paris, France

[21] Appl. No.: 400,369

[22] Filed: Jul. 21, 1982

[30] Foreign Application Priority Data

Aug. 5, 1981 [FR] France ..... 81 15205
Apr. 6, 1982 [FR] France ..... 82 05929

[51] Int. Cl.[3] ..... H01B 17/22
[52] U.S. Cl. ..... 174/172; 24/261 R
[58] Field of Search ..... 174/163 R, 168, 172, 174/173; 24/115 N, 131 C, 261 R, 261 C, 279, 283, 339; 248/74 R; 256/54, 55, 56, 57, DIG. 3

[56] References Cited

U.S. PATENT DOCUMENTS

| | | | |
|---|---|---|---|
| 996,211 | 6/1911 | Carswell | 256/55 |
| 2,421,286 | 5/1947 | Pyle | 174/173 |
| 2,643,283 | 6/1953 | Carlson | 174/173 X |
| 2,897,256 | 7/1959 | Kitselman et al. | 174/173 |
| 2,911,695 | 11/1959 | Knight et al. | 174/173 |
| 3,918,685 | 11/1975 | Lindsey et al. | 174/172 X |

FOREIGN PATENT DOCUMENTS

| | | | |
|---|---|---|---|
| Ad.41450 | 10/1932 | France | 174/172 |
| 1313890 | 11/1962 | France | 174/173 |
| 2393450 | 12/1978 | France | 174/173 |
| 2493585 | 5/1982 | France | 174/173 |

*Primary Examiner*—Laramie E. Askin
*Attorney, Agent, or Firm*—Kenyon & Kenyon

[57] ABSTRACT

The binding is disposed substantially symmetrically about a plane of symmetry which passes through the insulator (1) and which is orthogonal to said conductor (5). It comprises a ring (10), two conductor-retaining branches (11, 6), and tightening means (21, 22) for tightening the binding. Each of said branches comprises a first end portion (8, 9) in the form of a preformed spiral retainer for wrapping around said conductor, an intermediate portion (6) in the form of an arc of a circle having a radius of curvature that is substantially equal to the radius of the bottom of said circumferential groove, and a second end portion providing an eye for engaging the tightening means. Both branches pass through the ring at the transition between their spiral end portions and their intermediate arcuate portions. At least one elastomer block (20) is inserted between said eyes to be held in position by said tightening means drawing said eyes towards each other.

14 Claims, 7 Drawing Figures

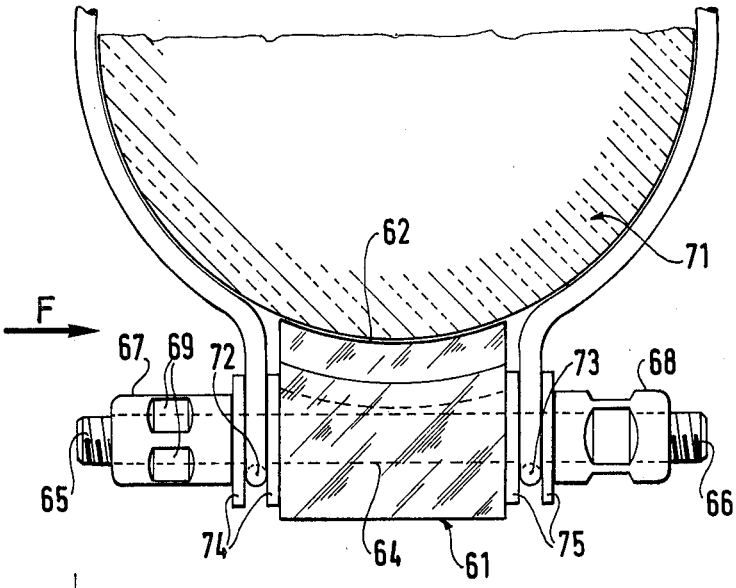
FIG.5
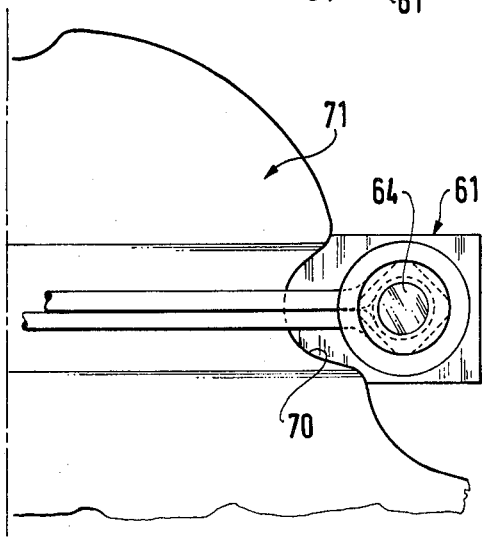
FIG.6
FIG.7
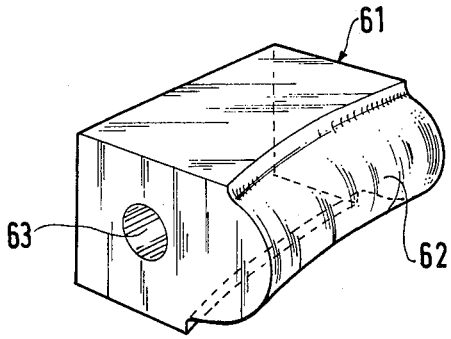

BINDING RETAINING AN ELECTRICAL CONDUCTOR IN A CIRCUMFERENTIAL GROOVE AROUND A RIGID INSULATOR

The present invention relates to a binding for retaining an electrical conductor in a circumferential groove around a rigid insulator.

It is applicable in particular to low and medium tension lines mounted on rigid insulators.

BACKGROUND OF THE INVENTION

Published French patent specification No. 2 493 585 filed in France on Nov. 4, 1980 describes one form of binding suitable for this purpose. The binding is resiliently folded in the middle to constitute a locking and unlocking zone which cooperates with unlocking and locking means. It is in the form of two branches which are substantially symmetrical, beginning with two arcs of a circle whose radius of curvature is substantially the same as the radius of the bottom of said groove, and which then pass through a common ring around which they are folded. Their ends on the other side of the ring constitute two respective spiral retainers wrapped around said cable.

Preferred embodiments of the present invention provide a binding which is of simpler manufacture than the above-described binding.

SUMMARY OF THE INVENTION

The present invention provides a binding for retaining a conductor in a circumferential groove around a rigid insulator, the binding being disposed substantially symmetrically about a plane of symmetry which passes through the insulator and which is orthogonal to said conductor, and comprising a ring, two conductor-retaining branches, and tightening means for tightening the binding, wherein each of said branches comprises a first end portion in the form of a preformed spiral retainer for wrapping around said conductor, an intermediate portion in the form of an arc of a circle having a radius of curvature that is substantially equal to the radius of the bottom of said circumferential groove, and a second end portion providing an eye for engaging the tightening means, with both branches passing through the ring at the transition between their spiral end portions and their intermediate arcuate portions, and wherein at least one elastomer block is inserted between said eyes to be held in position by said tightening means drawing said eyes towards each other.

In a preferred embodiment, each branch is constituted by at least one metal wire which is bent double in the middle to constitute said eye. Alternatively, the eye may be open in the form of a hook. Where there are two or more strands of metal wire making up a portion of a branch, they may be connected side by side to one another to form a ribbon-shaped member.

The ends of the wires are advantageously interconnected, eg. by glueing, soldering or welding, in order to avoid leaving sharp edges which could lead to accidents during handling or to radio interference.

In another embodiment, there are more than two strands over at least a portion of each branch of the binding. This may be particularly advantageous on leaving the eye.

In another preferred embodiment, the ring through which both branches pass is made from bent wire, with each portion of the ring in contact with one of the branches, comprising at least one hairpin bend superposed on at least one open spiral turn. Preferably the tips of the length of wire which is bent to make up the ring are slightly inwardly curved to avoid any outward projections.

In one variant the elastomer block is in the form of a cylinder.

In another variant, the face of the elastomer block which is liable to come into contact with the groove of the insulator is shaped to fit closely thereto. The tightening means may comprise a bolt cooperating with a nut rigidly buried in the middle of the block of elastomer.

BRIEF DESCRIPTION OF THE DRAWINGS

Embodiments of the invention are described by way of example with reference to the accompanying drawings, in which:

FIGS. 5 to 7 show a variant of the tightening means for use in the binding shown in FIGS. 1 and 2.

MORE DETAILED DESCRIPTION

Figure 1:
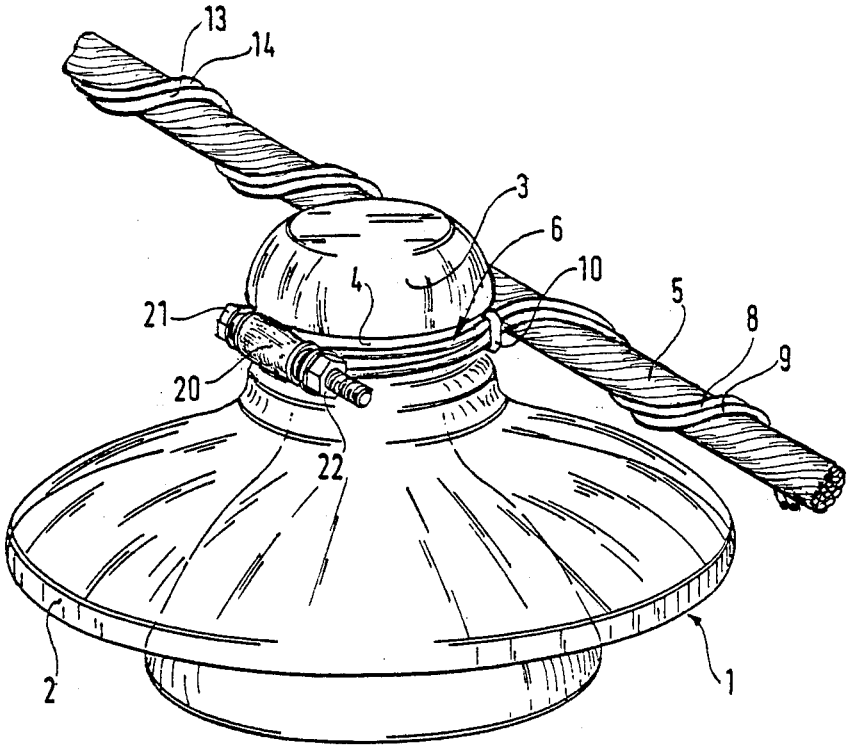
FIG. 1 is a perspective view of an insulator holding a cable and provided with a binding in accordance with the invention.
Figure 2:
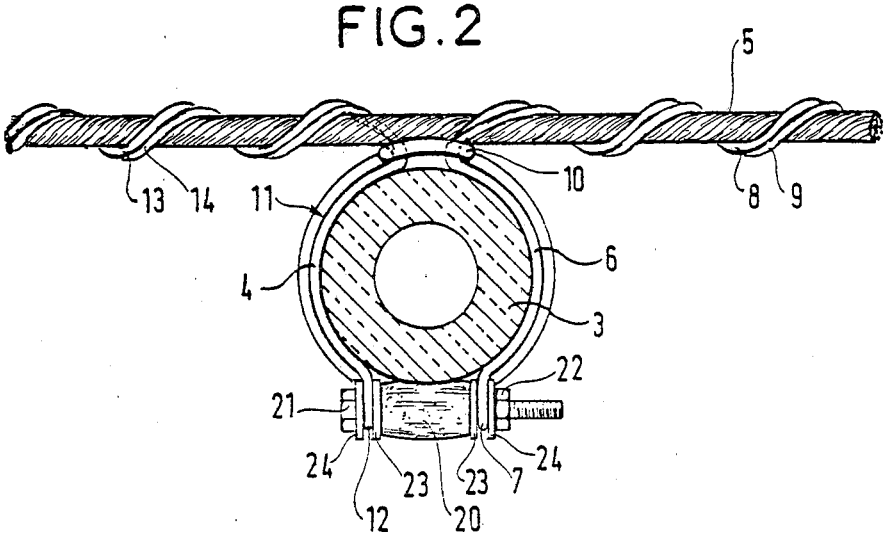
FIG. 2 is a plan view with parts in section of the insulator shown in FIG. 1.

FIGS. 1 and 2 show an insulator 1 comprising at least one skirt 2, a head 3, and an intermediate circumferential groove 4 intended to receive a cable 5. The cable is held in the groove 4 by means of a binding in accordance with the invention which includes two branches 6 and 8 that are substantially symmetrical.

The branch 6 is constituted by a resilient metal wire bent double to form an eye 7 and then a ribbon which fits into the curvature of the groove 4. The ribbon then passes through an elongate ring 10 which is described in greater detail below, and the two strands 8 and 9 are preformed into a spiral suitable for winding around the cable 5. The other branch 11 has the same structure with an eye 12 and two end strands 13 and 14.

It may be observed that the ring 10 also fits closely to the shape of the groove 4 in the insulator 1 and constitutes a linear bearing zone for the cable 5.

Both eyes 7 and 12 are placed against respective ends of an elastomer block 20 of generally cylindrical shape. Rigid intermediate washers 23 and 24 are provided for tightening. The assembly is compressed by a bolt 21 and a nut 22. The two branches 6 and 11 of the binding are tightened under the double effect of their eyes 7 and 12 being drawn together by the nut and bolt, and of the elastomer block 20 expanding.

To remove the cable 5 and its binding from the groove 4 in the insulator 1, it suffices to loosen the nut 22 sufficiently so that the assembly can be lifted off the head 3 of the insulator 1.

Figure 3:
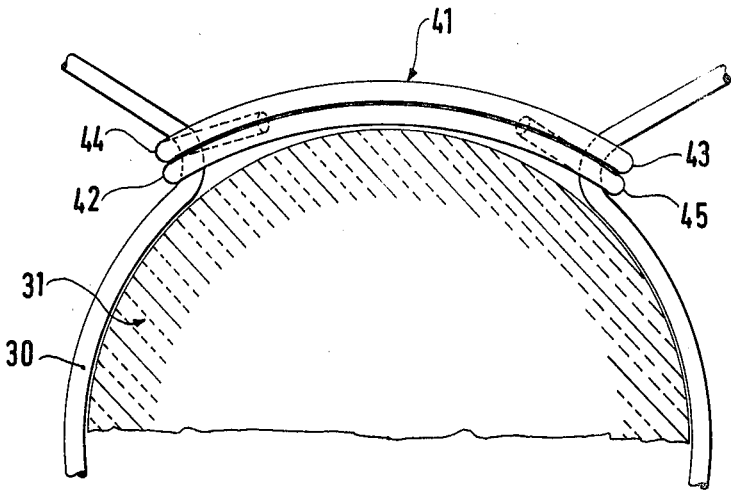
FIGS. 3 and 4 show a ring of the binding in greater detail.
Figure 4:
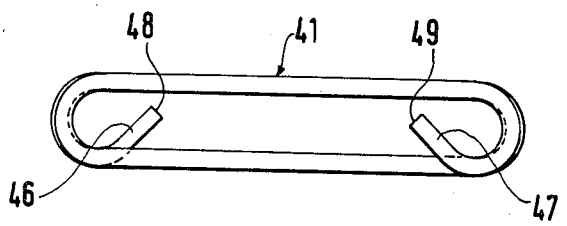

FIGS. 3 and 4 show a preferred embodiment of the ring 10 shown in FIGS. 1 and 2.

The ring, referenced 41 in these two figures, is made from a length of bent wire, having two hairpin bends 42 and 43 which are superposed with respective open spiral turns 44 and 45. Thus at the point where each of the branches of the binding, e.g. the branch reference 30 in these figures, passes through the ring, there are two load-bearing sections of wire, thereby reducing the risk of the branch being damaged by the ring.

Further, the tips 46 and 47 of the wire from which the ring 41 is made, are slightly bent inwardly so that they are "inside" the ring whereby their ends 48 and 49 are kept out of the way from damaging either the cable or the glass of the insulator, reference 31 in the figures. The wire used to make the ring 41 may be made from the alloy Alumoweld (aluminum +steel), or from stainless steel, or from the alloy Almelec.

FIGS. 5 to 7 show another embodiment of the tightening means used in the invention.

The block of elastomer 61 has a face 62 which is shaped to fit closely to the shape of the groove 70 in the insulator 71.

The block has a cylndrical bore 63 for receiving a metal rod 64 which is rigidly fixed therein, for example by means of anti-rotation tabs or by any other equivalent means. The ends 65 and 66 of the rod 64 are threaded and are intended to receive the eyes 72 and 73 of the respective branches, together with tightening washers 74 and 75 and two end nuts 67 and 68. The nut 67 has a rounded end in order to avoid radio interference; it has an intermediate portion 69 which is machined flat like a nut for tightening. Tightening can be performed at a distance by means of a suitable insulating tool. The nut 68 at the other end is identical to the nut 67.

The invention has numerous advantages.

Firstly, it is simple and cheap to manufacture. Secondly, the binding is easy to put into place, it is convenient when working under tension since there is no need to remove the binding from the cable when an insulator is being replaced.

Thirdly, its shape minimizes stress applied to the dielectric.

Fourthly, the block of elastomer ensures that the binding cannot rotate around the insulator since it presses tightly against the groove therein and acts as a brake by virtue of its high coefficient of friction against glass.

Naturally the invention is not limited to the embodiments which have just been described. In particular, the nut and bolt arrangements may be changed for any other arrangements suitable for remote handling, and the block of elastomer could be replaced by a stack of elastomer washers, for example having different diameters and glued together to constitute an effective single block.

We claim:

1. A binding for retaining an electrical conductor in a circumferential groove around a rigid insulator, the binding being disposed substantially symmetrically about a plane of symmetry which passes through the insulator and which is orthogonal to said conductor, and comprising a ring, two conductor-retaining branches, and tightening means for tightening the binding, wherein each of said branches comprises a first end portion in the form of a preformed spiral retainer for wrapping around said conductor, an intermediate portion in the form of an arc of a circle having a radius of curvature that is substantially equal to the radius of the bottom of said circumferential groove, and a second end portion providing an eye for engaging the tightening means, with both branches passing through the ring at the transition between their spiral end portions and their intermediate arcuate portions, and wherein at least one elastomer block is inserted between said eyes to be held in position by said tightening means drawing said eyes towards each other.

2. A binding according to claim 1, wherein each branch is constituted by at least one metal wire bent double in the middle to constitute said eye.

3. A binding according to claim 2, wherein said eye is open.

4. A binding according to claim 2, wherein said eye is closed.

5. A binding according to claim 2, wherein there are more than two wires over at least a portion of each branch.

6. A binding according to claim 2, wherein the strands of wire constituting the spiral retainer are connected to one another.

7. A binding according to claim 6, wherein said strands are glued to one another.

8. A binding according to claim 1, wherein the tightening means is constituted by a nut and a bolt.

9. A binding according to claim 8, wherein the tightening means includes tightening washers disposed on either side of said eyes.

10. A binding according to claim 1, wherein said elastomer block is cylindrical.

11. A binding according to claim 1, wherein said elastomer block is in the form of a stack of washers of different diameters.

12. A binding according to claim 1, wherein said elastomer block is convexly shaped where it is liable to come into contact with the peripheral groove to fit in the concave shape thereof.

13. A binding according to claim 1, wherein said ring is made from bent wire, and wherein each portion of the ring through which one of the branches passes comprises at least one hairpin bend superposed on at least one open spiral turn.

14. A binding according to claim 13, wherein the tips of the length of wire which is bent to make up the ring are slightly curved to avoid projecting outwardly.

* * * * *